US005277595A

United States Patent [19]

Clark

[11] Patent Number: 5,277,595

[45] Date of Patent: Jan. 11, 1994

[54] POWER RECEPTACLE FOR A DAUGHTERBOARD

[75] Inventor: Stephen L. Clark, Dillsburg, Pa.

[73] Assignee: E. I. Du Pont de Nemours and Company, Wilmington, Del.

[21] Appl. No.: 905,422

[22] Filed: Jun. 29, 1992

[51] Int. Cl.[5] ..... H01R 9/09

[52] U.S. Cl. ..... 439/75; 439/78; 439/844

[58] Field of Search ..... 439/55, 63, 74, 75, 439/78, 82, 737, 738, 842, 843, 844

[56] References Cited

U.S. PATENT DOCUMENTS

| | | | |
|---|---|---|---|
| 3,675,185 | 7/1972 | Ruehlemann et al. . | |
| 3,892,462 | 7/1975 | Glover et al. . | |
| 4,002,400 | 1/1977 | Evans . | |
| 4,329,006 | 5/1982 | Gale . | |
| 4,359,258 | 11/1982 | Palecek et al. . | |
| 4,420,767 | 12/1983 | Hodge et al. | 439/78 X |
| 4,464,006 | 8/1984 | Wilt . | |
| 4,530,551 | 7/1985 | Bengsutti | 439/78 |
| 4,541,683 | 9/1985 | Van Domelen . | |
| 4,582,386 | 4/1986 | Martens . | |
| 4,749,357 | 6/1988 | Foley | 439/78 X |
| 4,790,763 | 12/1988 | Weber et al. | 439/65 |
| 4,824,380 | 4/1989 | Matthews | 439/78 |
| 5,055,055 | 10/1991 | Bakker | 439/78 |
| 5,059,130 | 10/1991 | Miller, Jr. | 439/74 |

OTHER PUBLICATIONS

Du Pont HPC Connector System Bulletin 712, pp. 6, 12, 15, and 18, Jan. 1987.

*Primary Examiner*—Larry I. Schwartz
*Assistant Examiner*—Khiem Nguyen
*Attorney, Agent, or Firm*—Woodcock Washburn Kurtz Mackiewicz & Norris

[57] ABSTRACT

In a system including a motherboard and a daughterboard a receptacle is disposed in an insulated housing mounted on the motherboard while a pin is disposed on the daughterboard. The receptacle comprises a socket and an integral threaded shank, the socket portion having an enlarged collar with an abutment surface thereon. The receptacle has a central and axial passage. The collar is larger than the dimension of an opening extending through the motherboard while the shank is sized to pass therethrough and to present the threads to the second surface thereof. A threaded nut engages with the threads on the shank accessible from the second surface of the motherboard. When the nut is threaded onto the shank the receptacle is held mechanically to the motherboard and into electrical connection with a conductive path thereon.

5 Claims, 1 Drawing Sheet

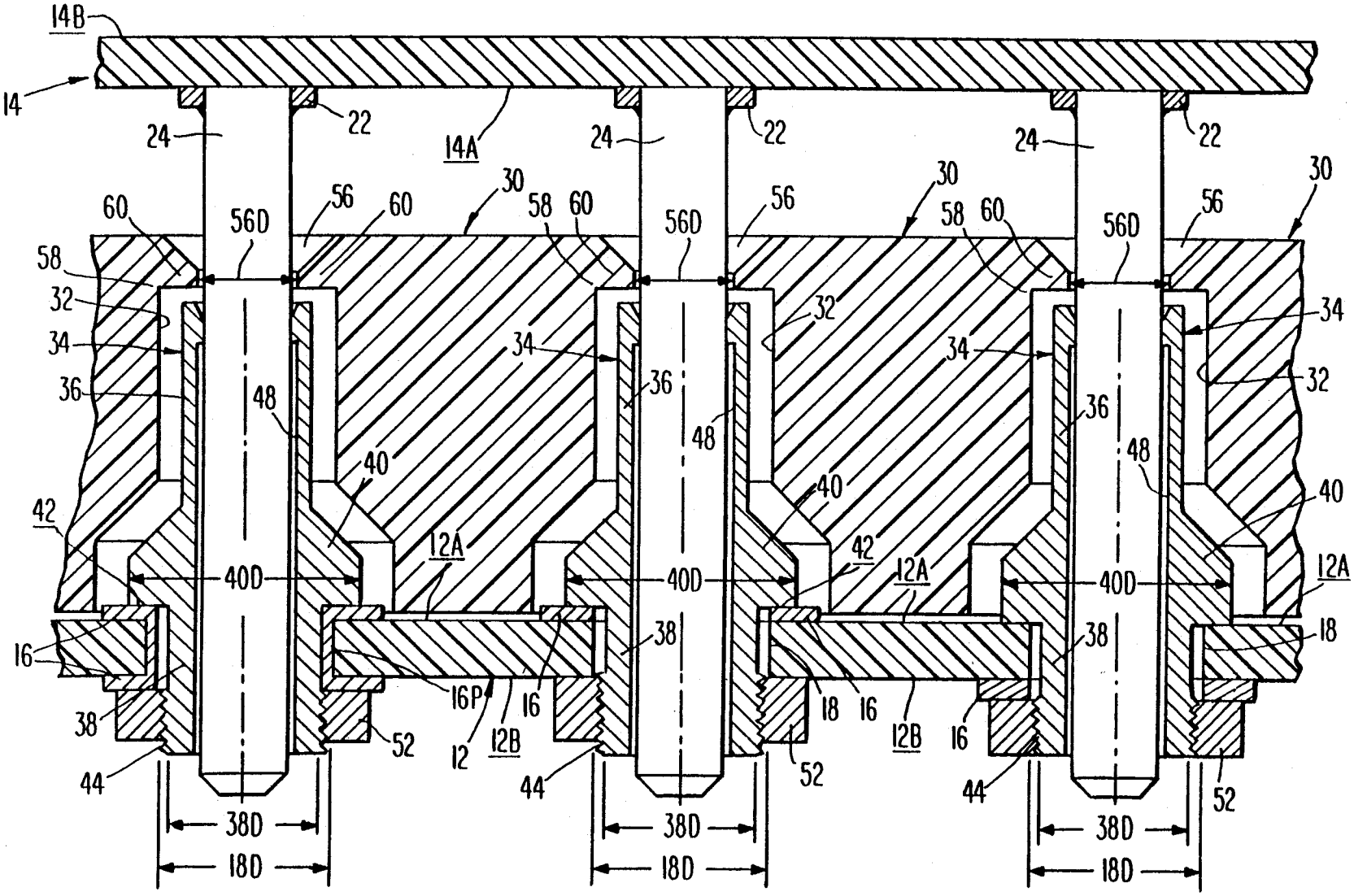
30
34
32
40
12A
18
52
22
56
48
56D
40D
38D
18D
36
38
24
60
58
44
16
12B
42
14A
16P
12
14B
14

POWER RECEPTACLE FOR A DAUGHTERBOARD

BACKGROUND OF THE INVENTION

1. Field of the Invention

The present invention relates to a power receptacle, and to the utilization of the same on a daughterboard.

2. Description of the Prior Art

Presently, a wide variety of electronic systems, such as a microprocessor-based computer system, use a packaging arrangement comprised of a motherboard and one or more interconnected daughterboards. The motherboard carries signals into and from the electronic system, along with grounding paths and the system power bus. The daughterboard more typically contains the actual functioning components of the system, such as the microprocessor chip, logic device chips and memory chips. These components are connected together by suitable conductive paths provided on or within the daughterboard. The daughterboard, however, is not itself provided with a conductive path that is connectible to a power source. Power for the daughterboard must be derived from the motherboard.

The usual arrangement for providing power to the components on the daughterboard employs a power pin that is mounted to the motherboard. The pin is electrically connected with the power bus. The power pin projects from the motherboard and is accepted into a power receptacle mounted on the daughterboard.

The power receptacle is usually disposed within a generally enclosed, insulating housing, or header, that is secured to the daughterboard. However, the power pin extends from the motherboard in an open, i.e., electrically unprotected, fashion. Thus the power pin is exposed to a relatively high risk of making shorting contact with another member. It also can be appreciated that the exposed power pin, when electrically "live" (i.e., when connected to an electrically conducting power bus) poses a serious safety hazard for an operator.

U.S. Pat. No. 4,790,763 (Weber et al.) and U.S. Pat. No. 4,582,386 (Martens) each disclose a connector assembly for interconnecting a motherboard to a daughterboard.

In view of the foregoing it is believed advantageous to provide a packaging arrangement for an electronic system wherein the risk of short circuit or safety hazards posed by unprotected electrically "live" power pins is reduced.

SUMMARY OF THE INVENTION

In one aspect the present invention relates to a system including a first substrate (e.g., a motherboard) and a second substrate (e.g., a daughterboard), each substrate having a conductive path thereon. The conductive path on the first substrate is connectible to a source of power. In accordance with the present invention the improvement comprises a receptacle disposed in an insulated housing mounted on the motherboard, the receptacle being connected in electrical contact with the conductive path thereon. A pin disposed on the daughterboard is connected in electrical contact with the conductive path on the second substrate. By disposing the pin on the daughterboard and the receptacle within an insulated housing on the motherboard the hazard of shock is eliminated.

In another aspect the present invention is directed to a receptacle comprising a socket portion and an integral shank portion, the socket portion having an enlarged collar with an abutment surface thereon. The dimension of the collar is sized to be greater than the dimension of an opening extending through the motherboard. The shank has threads thereon. The dimension of the shank is less than the dimension of the opening in the motherboard such that the shank may through the motherboard and present the threads thereon to the second surface thereof. The receptacle has a passage extending centrally and axially therethrough. A threaded nut is engagable with the threads on the shank accessible from the second surface of the motherboard. When the nut is threaded onto the shank the receptacle is held mechanically to the motherboard and into electrical connection with the conductive path thereon.

BRIEF DESCRIPTION OF THE DRAWINGS

The invention will be more fully understood from the following detailed description, taken in accordance with the accompanying drawing, which form a part of this application and in which:

the sole FIGURE is a side elevational view, in section, of a power receptacle in accordance with the present invention mounted to a substrate having a conductive path connectible to a source of power, also in accordance with the present invention.

DETAILED DESCRIPTION OF THE INVENTION

An electronic system generally indicated by the reference character 10 includes a first substrate, or motherboard, 12 and at least one second substrate, or daughterboard 14. The motherboard 12 and the daughterboard 14 may be implemented in any convenient manner, such as with a printed circuit board or a flexible circuit substrate.

The motherboard 12 has a first surface 12A and a second surface 12B thereon. The motherboard 12 may have a conductive path 16 disposed on either the first surface 12A or the second surface 12B thereof. The conductive path 16 is connectible to a source of electric power and may thus define the system power bus. In the typical instance the conductive path 16 is located on the second surface 12B of the motherboard 12, as generally indicated in the righthand region of the Figure. However, for purposes of later discussion, it should be understood that the conductive path 16 may be located on the first surface 12A of the motherboard 12, as is indicated in the central region of the Figure. In addition, a conductive path 16 may disposed on both the first or second surface 12A, 12B of the motherboard 12, with the paths 16 being connected by the plating 16P lining an opening 18, as is shown in the lefthand region of the Figure. The embodiment shown in the lefthand portion of the Figure is also meant to illustrate a situation in which the conductive path 16 is disposed on only one surface and a conductive pad is provided on the other surface, with the path and pad being optionally connected by the plating 16P.

The motherboard 12 has an opening 18 extending therethrough. The opening 18 has a dimension 18D. The opening 18 extends through the substrate 12 and the conductive path 16 disposed thereon. The disposition of the opening 18 as extending through the path 16 when the same is located on the second surface 12B of the motherboard 12 is shown in the righthand portion of the Figure. The disposition of the opening 18 as extending through the path 16 when the path 16 is located on the first surface 12A of the motherboard 12 is shown in the central portion of the Figure. The opening 18 may be plated, as is illustrated in the lefthand portion of the Figure.

The daughterboard 14 has a first surface 14A and a second surface 14B thereon. The daughterboard 14 also has a conductive path 22 disposed on either the first surface 14A or the second surface 14B thereof. In accordance with this invention the conductive path 22 is connected to an electrically conductive power pin 24 that projects from the daughterboard 14. The power pin 24 may take any of a variety of well-known forms.

The point to note is that in accordance with the present invention the power pin 24 is interconnected to the conductive path 22 on the daughterboard 14. Since this conductive path 22 on the daughterboard 14 is not used to form the system power bus and is not connected to a source of power, the pin 24 is not electrically "live". Accordingly, the power pin 24 extending from the daughterboard does not present a shock hazard.

The motherboard 12 has an insulated housing 30 mounted thereto by any convenient means of attachment. The housing 30 has an internal recess 32 in which a power receptacle 34 in accordance with the invention is received. The power receptacle 34 includes a socket portion 36 and an integral shank portion 38. The socket portion 36 has an enlarged collar 40 with an abutment surface 42 thereon. The dimension 40D of the collar 40 is greater than the dimension 18D of the opening 18 in the motherboard 12.

The shank portion 38 of the power receptacle 34 has threads 44 thereon. The shank 38 has a dimension 38D that is less than the dimension 18D of the opening 18 in the substrate 12, thereby to pass therethrough. The threads 44 are accessible from the second surface 12B of the motherboard 12, as may be appreciated from the righthand, central and lefthand regions of the Figure.

The socket portion 36 and the shank portion 38 have a passage 48 extending centrally and axially therethrough. Since the passage 48 extends completely therethrough the receptacle 34 is able to receive a power pin 34 of any length. A power port terminal also able to receive a power pin of any length is disclosed and claimed in copending application Ser. No. 07/843,261, filed Feb. 12, 1992 assigned to the assignee of the present invention.

The power receptacle also includes a threaded nut 52. The nut 52 is engagable with those threads 44 on the shank portion 38 that are accessible from the second surface 12B of the motherboard 12. When engaged the nut 52 holds the abutment surface 42 on the collar 40 into mechanical engagement with the motherboard 12.

If the opening 18 extends through the conductive path 16, whether the same be disposed on the second surface 12B or the first surface 12A of the motherboard 12, engagement of the threaded nut 52 also electrically interconnects the receptacle 34 to the conductive path 16. As seen in the righthand portion of the Figure, when the path 16 is disposed on the second surface 12B, threading the nut 52 to the shank 44 brings the abutment surface 42 into physical engagement with the first surface 12A of the motherboard to mechanically hold the receptacle thereto. The physical contact between the nut 52 and the path 16 establishes the electrical connection of the receptacle 34 to the path 16. When the path 16 is disposed on the first surface 12A securing the receptacle is mechanically secured by the engagement of the abutment surface 42 with the second surface 12B brought about by the threading of the nut 52 onto the shank 38. Electrical contact in this case is made by the physical contact between the collar 40 and the path 16, as is illustrated in the central portion of the Figure.

In the case of a path on both surfaces, or a path on one surface and a pad on the other, both connected by the plating 16P, both the abutment surface 42 on the collar 40 and the threaded nut 52 establish electrical contact. Threading of the nut 52 to the shank 38 again serves to mechanically secure the receptacle to the motherboard.

Access to the recess 32 in the housing 30 is afforded through the opening 56 therein. The material of the housing 30 is undercut, as at 58, thereby to define an overhanging lip portion 60 surrounding the opening 56. The dimension 56D of the opening 56 is defined by the lip 60, and is sized to receive the pin 24. The presence of the lip 60 serves to prevent the insertion of the tip of a human digit into the recess 32, thereby to further protect an operator from shock hazard presented by an electrically live receptacle.

Those skilled in the art, having the benefit of the teachings of the present invention as hereinabove set forth may effect numerous modifications thereto. For example, in place of the external threads on the shank and the nut 52, the shank 38 may be internally threaded and a screw with an enlarged head may be threaded into the lower end of the shank to form the mechanical and electrical connections discussed above. This and other modifications which appear to those skilled in the art are to be construed as lying within the scope of the present invention, as defined by the appended claims.

What is claimed is:

1. In a system comprising a first substrate and a second substrate, each substrate having a conductive path thereon, the conductive path on the first substrate being connectible to a source of power, the improvement comprising:

a receptacle disposed in an insulated housing mounted to the first substrate, the housing having an opening communicating with an internal recess, the recess receiving the receptacle therein, the housing being undercut to define a lip surrounding the opening, the opening being sized to accept a pin but to prevent the entry of a human digit into the recess, the receptacle being connected in electrical contact with the conductive path on the first substrate, wherein the receptacle itself comprises:

a socket portion and an integral shank portion, the socket portion having an enlarged collar with an abutment surface thereon, the dimension of the collar being greater than the dimension of the opening in the substrate, the shank having threads thereon, the shank having a dimension less than the dimension of the opening in the substrate thereby to pass therethrough so that a portion of the threads is accessible from the second surface of the substrate, the socket and the shank having a passage extending centrally and axially therethrough; and a threaded nut engagable with the threads on the shank accessible from the second surface thereby to hold the abutment surface on the collar into engagement with the substrate, and, a pin disposed on the second substrate, the pin being connected in electrical contact with the conductive path on the second substrate.

2. The system of claim 1 wherein at least the first surface of the substrate has the conductive path connectible to a source of power disposed thereon, the opening in the substrate extending through the conductive path so that when the nut is engaged with the threads on the shank the nut engages against the second surface of the substrate and the abutment surface on the collar physically contacts the conductive path thereby to hold mechanically the receptacle to the substrate and to interconnect electrically the receptacle to the conductive path.

3. The system of claim 1 wherein at least the second surface of the substrate has the conductive path connectible to a source of power disposed thereon, the opening in the substrate extending through the conductive path so that when the nut is engaged with the threads on the shank the abutment surface on the collar engages against the first surface of the substrate and the nut physically contacts the conductive path thereby to hold mechanically the receptacle to the substrate and to interconnect electrically the receptacle to the conductive path.

4. The system of claim 3 wherein the first surface of the substrate also has a conductive path thereon, the opening being located in the substrate being plated to interconnect the conductive paths on the first and second surfaces.

5. The system of claim 2 wherein the second surface of the substrate also has a conductive path thereon, the opening being located in the substrate being plated to interconnect the conductive paths on the first and second surfaces.

* * * * *